US007953354B2

(12) United States Patent
Hara

(10) Patent No.: US 7,953,354 B2
(45) Date of Patent: May 31, 2011

(54) TRANSFER BELT UNIT FOR IMAGE FORMING APPARATUS

(75) Inventor: Kazuhiro Hara, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 85 days.

(21) Appl. No.: 12/485,590

(22) Filed: Jun. 16, 2009

(65) Prior Publication Data

US 2009/0311013 A1 Dec. 17, 2009

Related U.S. Application Data

(60) Provisional application No. 61/073,001, filed on Jun. 16, 2008.

(51) Int. Cl.
*G03G 15/01* (2006.01)

(52) U.S. Cl. ..... 399/302

(58) Field of Classification Search ..... 399/162, 399/167, 302, 303, 308, 312
See application file for complete search history.

(56) References Cited

U.S. PATENT DOCUMENTS

| | | | | | |
|---|---|---|---|---|---|
| 4,935,778 | A * | 6/1990 | Mochida | 399/167 |
| 5,708,933 | A * | 1/1998 | Nogami et al. | 399/167 |
| 6,456,807 | B1 * | 9/2002 | Makino et al. | 399/167 |
| 6,990,304 | B2 * | 1/2006 | Mitamura et al. | 399/167 |
| 7,130,563 | B2 * | 10/2006 | Hara | 399/116 |
| 2007/0228647 | A1 | 10/2007 | Hara | |

FOREIGN PATENT DOCUMENTS

| | | | |
|---|---|---|---|
| JP | 09166924 | A * | 6/1997 |
| JP | 09292752 | A * | 11/1997 |
| JP | H9-292778 | A | 11/1997 |
| JP | 10293477 | A * | 11/1998 |
| JP | 2000147853 | A * | 5/2000 |
| JP | 2000249202 | A * | 9/2000 |
| JP | 2002244378 | A * | 8/2002 |
| JP | 2006-095763 | | 4/2006 |
| JP | 2007-264292 | A | 10/2007 |
| JP | 2007-279148 | A | 10/2007 |

* cited by examiner

*Primary Examiner* — Robert Beatty
(74) *Attorney, Agent, or Firm* — Patterson & Sheridan, LLP

(57) ABSTRACT

A flywheel is coupled to a driven roller to support, at a secondary transfer position, an intermediate transfer belt that, together with a secondary transfer roller, nips and conveys a sheet. A direction of a shaft of the flywheel has an angle of 90° with respect to a direction of a shaft of the driven roller, and the flywheel is arranged in a hollow inside of the intermediate transfer belt. A second belt of a link mechanism is twisted, and the flywheel is coupled to the driven roller.

21 Claims, 6 Drawing Sheets

TRANSFER BELT UNIT FOR IMAGE FORMING APPARATUS

CROSS REFERENCE TO RELATED APPLICATION

This invention is based upon and claims the benefit of priority from Provisional U.S. Patent Application 61/073,001 filed on Jun. 16, 2008, the entire contents of which are incorporated herein by reference.

TECHNICAL FIELD

The present invention relates to a transfer belt mounted in an image forming apparatus such as a copier or a printer, and particularly to a transfer belt unit of an image forming apparatus for preventing an image blur due to a speed fluctuation of a transfer belt.

BACKGROUND

In an image forming apparatus such as a multi function peripheral (MFP) or a printer, there is an apparatus for transferring a toner image formed on a transfer belt to a sheet while the sheet is nipped and conveyed by the transfer belt and a transfer roller.

In the apparatus in which the sheet is nipped and conveyed by the transfer belt and the transfer roller at the time of the transfer, there is a fear that a transfer blur occurs due to the fluctuation of the conveying speed of the transfer belt. There is a fear that the speed of the transfer belt is fluctuated when the leading edge of the sheet enters between the transfer belt and the transfer roller, or the trailing edge of the sheet comes out from between the transfer belt and the transfer roller. There is a fear that the speed of the transfer belt is fluctuated when the sheet is extending between the registration roller and the transfer belt and the trailing edge of the sheet comes out from the registration roller. There is a fear that the speed of the transfer belt is fluctuated when the sheet is nipping by the transfer belt and the transfer roller and the leading edge of the sheet enters the fixing roller.

Hitherto, for example, Japanese Patent Application No. 2006-095763 discloses an apparatus for preventing the conveying speed of a sheet from abruptly increasing when the trailing edge of the sheet comes out from a registration roller.

However, the apparatus of the related art does not prevent the conveying speed of a transfer belt from changing.

Then, the development of a transfer belt unit of an image formation apparatus is desired in which the speed fluctuation of a transfer belt is suppressed irrespective of the operation of a sheet, so that a transfer blur is prevented, and a high quality image can be obtained.

SUMMARY

An aspect of the invention is to prevent the speed fluctuation of a transfer belt irrespective of an operation of a sheet. By this, a high quality toner image without transfer blur can be certainly obtained.

According to an embodiment of the invention, a transfer belt unit includes an endless transfer belt that nips a recording medium between the endless transfer belt and an opposite member and conveys the recording medium, a support roller to support the transfer belt at a position where the recording medium is nipped, a flywheel arranged in a hollow inside of the transfer belt, and a coupling to couple the flywheel to the support roller.

DETAILED DESCRIPTION

Figure 1:
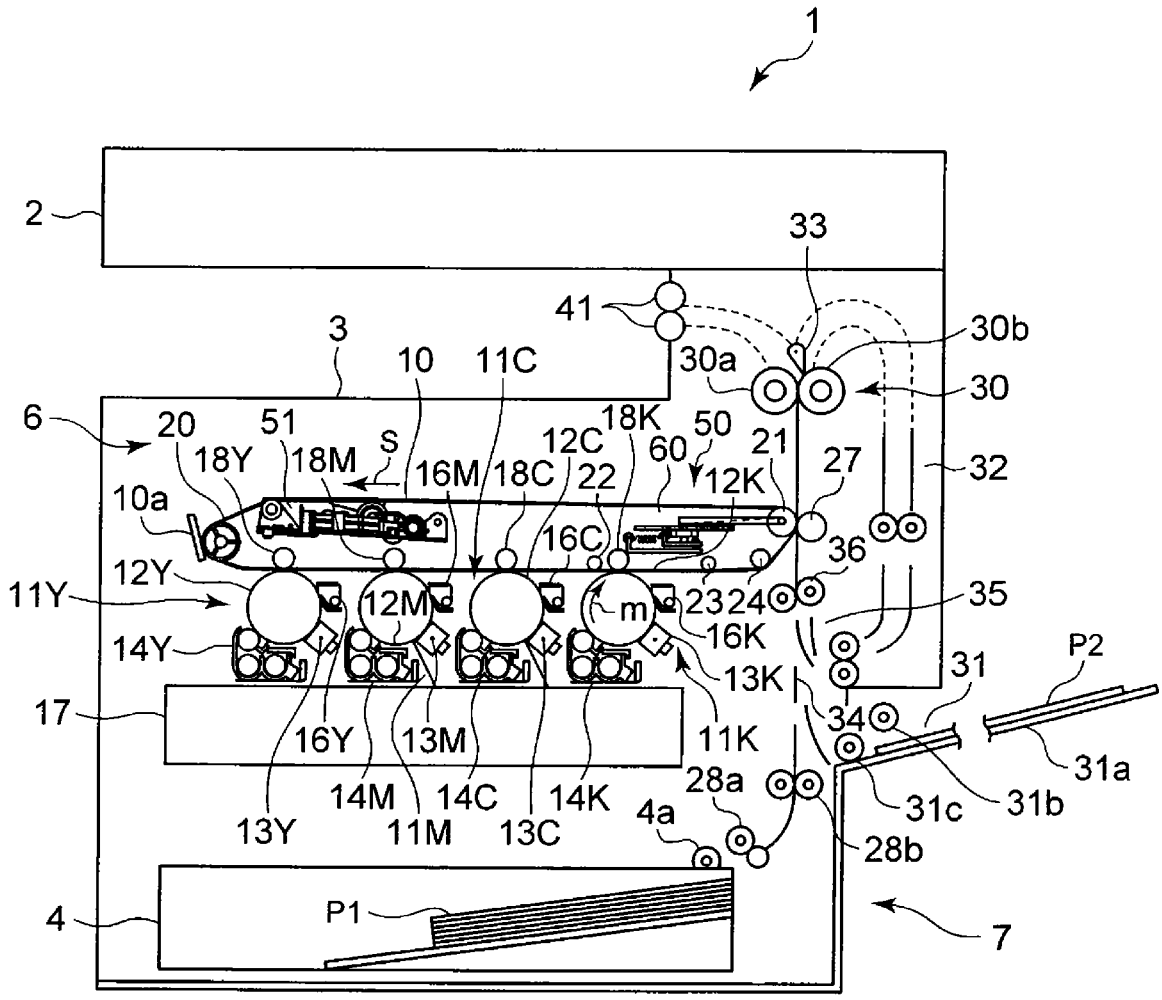
FIG. 1 is a schematic structural view showing a color copier of an embodiment.

Hereinafter, an embodiment will be described in detail with reference to the accompanying drawings. FIG. 1 is a schematic structural view showing a color copier 1 of four-tandem system in which a transfer belt unit 50 of the embodiment is mounted. The color copier 1 includes a scanner section 2 and a sheet ejecting section 3 at an upper part. The color copier 1 includes a printer section 6 and a sheet feeding section 7.

The transfer belt unit 50 of the printer section 6 includes an intermediate transfer belt 10 as a transfer belt. The printer section 6 includes four sets of image forming stations 11Y, 11M, 11C and 11K of yellow (Y), magenta (M), cyan (C) and black (K) arranged in tandem along the lower side of the intermediate transfer belt 10 rotated in an arrow s direction. The printer section 6 includes a laser exposure device 17. The laser exposure device 17 irradiates laser beams corresponding to image information to photoconductive drums 12Y, 12M, 12C and 12K of the image forming stations 11Y, 11M, 11C and 11K of the respective colors. The image forming stations 11Y, 11M, 11C and 11K of the respective colors and the laser exposure device 17 constitute an image forming member.

In the respective image forming stations 11Y, 11M, 11C and 11K, chargers 13Y, 13M, 13C and 13K, developing devices 14Y, 14M, 14C and 14K, and cleaners 16Y, 16M, 16C and 16K are respectively arranged around the respective photoconductive drums 12Y, 12M, 12C and 12K rotating in an arrow m direction.

The developing devices 14Y, 14M, 14C and 14K respectively have two-component developers containing toners of yellow (Y), magenta (M), cyan (C) and black (K) and carriers, and supplies the toners to electrostatic latent images on the photoconductive drums 12Y, 12M, 12C and 12K.

Figure 2:
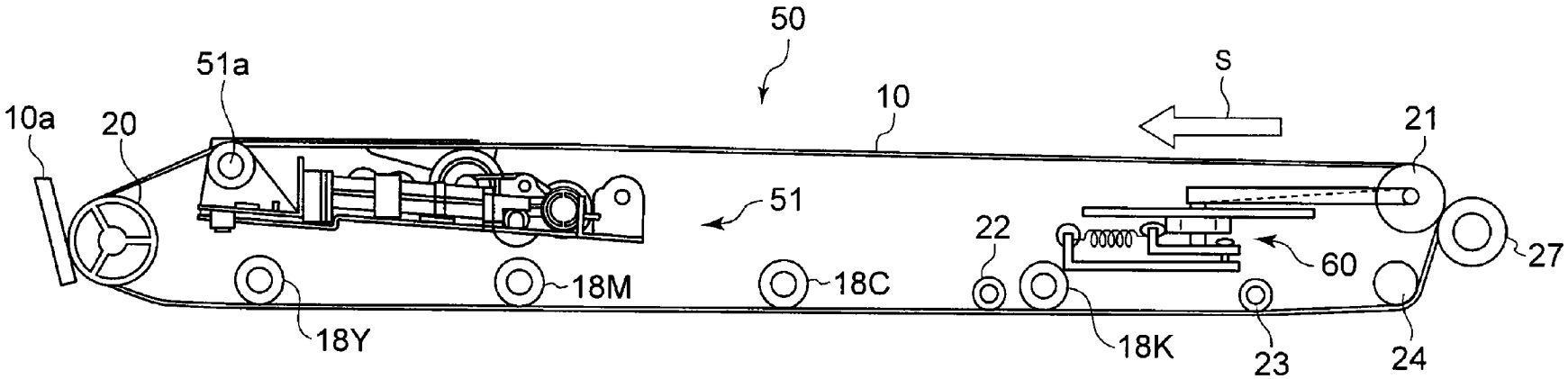
FIG. 2 is a schematic structural view of a transfer belt unit of the embodiment.
Figure 3:
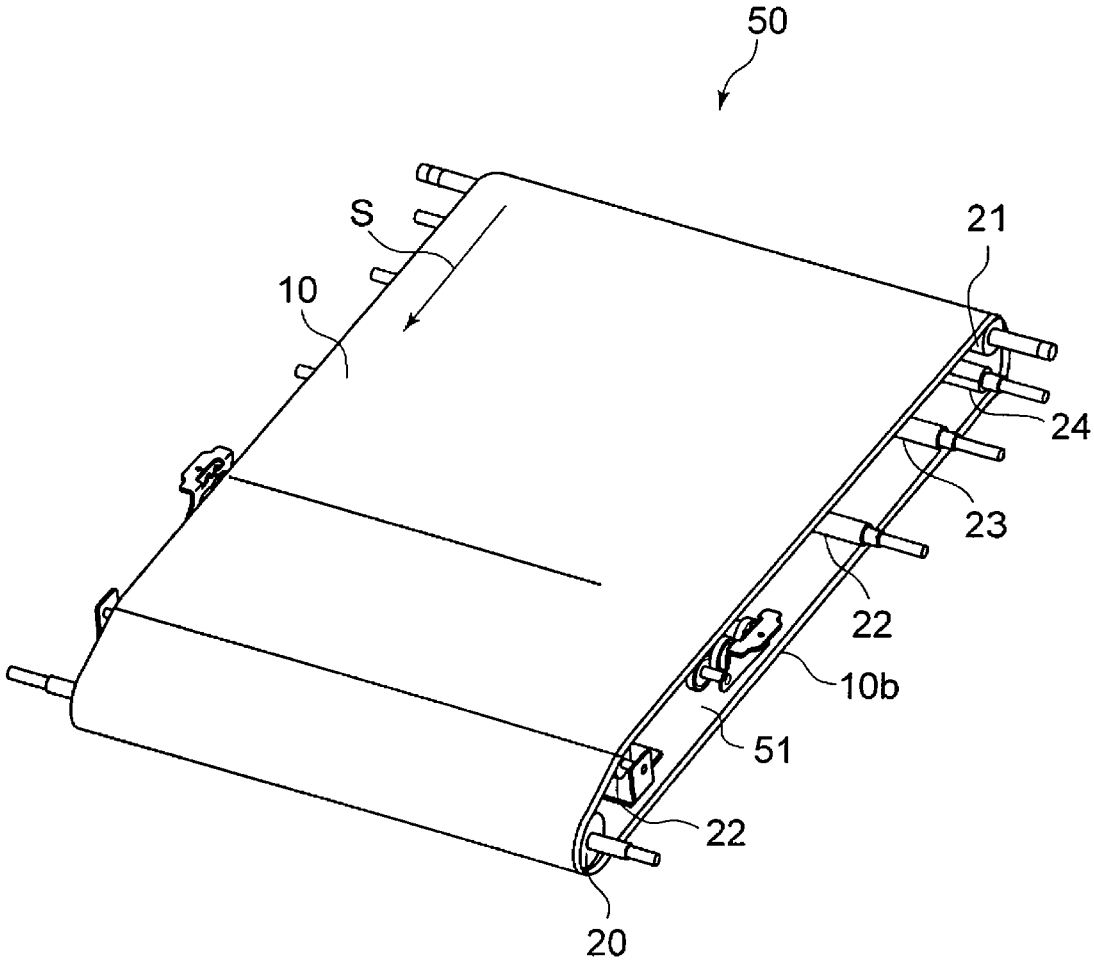
FIG. 3 is a schematic perspective view showing the transfer belt unit of the embodiment.

As shown in FIG. 2 and FIG. 3, a drive roller 20, a driven roller 21 and first to third tension rollers 22 to 24 of the transfer belt unit 50 stretch the intermediate transfer belt 10. Further, a steering roller 51*a* of a self steering mechanism 51 stretches the intermediate transfer belt 10 to prevent a meandering of the intermediate transfer belt 10.

Primary transfer rollers 18Y, 18M, 18C and 18K are located at positions opposite to the respective photoconductive drums 12Y, 12M, 12C and 12K across the intermediate transfer belt 10. Primary transfer biases are respectively supplied to the primary transfer rollers 18Y, 18M, 18C and 18K.

The respective primary transfer rollers 18Y, 18M, 18C and 18K primarily transfer toner images on the photoconductive drums 12Y, 12M, 12C and 12K to the intermediate transfer belt 10.

The driven roller 21 as a support roller supports the intermediate transfer belt 10 at a secondary transfer position. A secondary transfer roller 27 as an opposite member is opposite to the intermediate transfer belt 10 at the secondary transfer position. A secondary transfer bias is supplied to the secondary transfer roller 27. The intermediate transfer belt 10 and the secondary transfer roller 27 nips and conveys a sheet P as a recording medium and secondarily transfer the toner image on the intermediate transfer belt 10 to the sheet P or the like.

The driven roller 21 is coupled to a flywheel mechanism 60 having a large inertia moment. Incidentally, the structure of the transfer belt unit 50 is not limited to this. After the end of the secondary transfer, the intermediate transfer belt 10 is cleaned by a belt cleaner 10*a*.

The sheet feeding section 7 includes a sheet feed cassette 4 for feeding the sheet P in the direction of the secondary transfer roller 27, and a manual feed mechanism 31 for manually feeding the sheet P.

A vertical conveying path 34 exists between the sheet feed cassette 4 and the secondary transfer roller 27. The vertical conveying path 34 includes a pickup roller 4*a*, a separation roller 28*a*, a conveyance roller 28*b* and a registration roller pair 36. A manual feed pickup roller 31*b* and a manual feed separation roller 31*c* exist between the manual feed tray 31*a* of the manual feed mechanism 31 and the registration roller pair 36.

A fixing device 30 including a heat roller 30*a* and a pressure roller 30*b* exists downstream of the secondary transfer roller 27 of the printer section 6 along the direction of the vertical conveying path 34.

The sheet P taken out from the sheet feed cassette 4 or fed from the manual feed mechanism 31 reaches the fixing device 30 along the vertical conveying path 34 through the resister roller pair 36 and the secondary transfer roller 27. The fixing device 30 fixes a toner image to the sheet P by heat treatment. A gate 33 exists downstream of the fixing device 30, and distributes the sheet P in the direction of a sheet ejecting roller 41 or the direction of a re-conveying unit 32. The sheet P guided to the sheet ejecting roller 41 is ejected to the sheet ejecting section 3. The sheet P guided to the re-conveying unit 32 is again guided in the direction of the secondary transfer roller 27.

In the printer section 6, the photoconductive drums 12Y, 12M, 12C and 12K of the image forming stations 11Y, 11M, 11C and 11K are respectively rotated in an arrow m direction by the start of a print operation. While the respective photoconductive drums 12Y, 12M, 12C and 12K are rotated, the chargers 13Y, 13M, 13C and 13K uniformly charge the photoconductive drums 12Y, 12M, 12C and 12K, respectively. The laser exposure device 17 irradiate exposure lights corresponding to the image information of the respective colors and forms electrostatic latent images on the photoconductive drums 12Y, 12M, 12C and 12K.

Thereafter, the developing devices 14Y, 14M, 14C and 14K develop the electrostatic latent images on the respective photoconductive drums 12Y, 12M, 12C and 12K. At the positions of the primary transfer rollers 18Y, 18M, 18C and 18K, the respective toner images on the respective photoconductive drums 12Y, 12M, 12C and 12K are primarily transferred to the intermediate transfer belt 10 rotated in the arrow s direction. The intermediate transfer belt 10 has a full color toner image formed by multiple transferring the toner images of black (K), yellow (Y), magenta (M) and cyan (C). When the intermediate transfer belt 10 meanders at the time of rotation in the arrow s direction, the steering roller 51*a* is inclined to correct the traveling direction of the intermediate transfer belt 10.

After the end of the primary transfer, the cleaners 16Y, 16M, 16C and 16K clean the remaining toners on the respective photoconductive drums 12Y, 12M, 12C and 12K. Next printing becomes possible in the respective image forming stations 11Y, 11M, 11C and 11K.

The secondary transfer roller 27, together with the intermediate transfer belt 10, nips and conveys the sheet P, and secondarily transfers the full color toner image on the intermediate transfer belt 10 onto the sheet P at once. The sheet P is fed to between the intermediate transfer belt 10 and the secondary transfer roller 27 in synchronization with the full color toner image on the intermediate transfer belt 10.

Thereafter, the sheet P having the full color toner image is subjected to fixing so that the print image is completed, and then is ejected to the sheet ejecting section. For example, the sheet P is taken out by the pickup roller 4*a* from the sheet feed cassette 4, and reaches the registration roller pair 36 through the separation roller 28*a* and the conveyance roller 28*b*. After the leading edge of the sheet P is aligned, the registration roller pair 36 starts to rotate and feeds the sheet P to the secondary transfer position. Thereafter, the toner image on the intermediate transfer belt 10 is transferred to the sheet P at the secondary transfer position, and is heated, pressed and fixed by the fixing device 30, and the fixed toner image on the sheet P is completed. After the fixing, the sheet P passes through the gate 33 and is directly ejected to the in-housing sheet ejecting section 3 by the sheet ejecting roller 41 in the case of one-side image formation. When both sides image formation or multiple printing is performed, the sheet is again conveyed to the secondary transfer position through the re-conveying unit 32.

Figure 4:
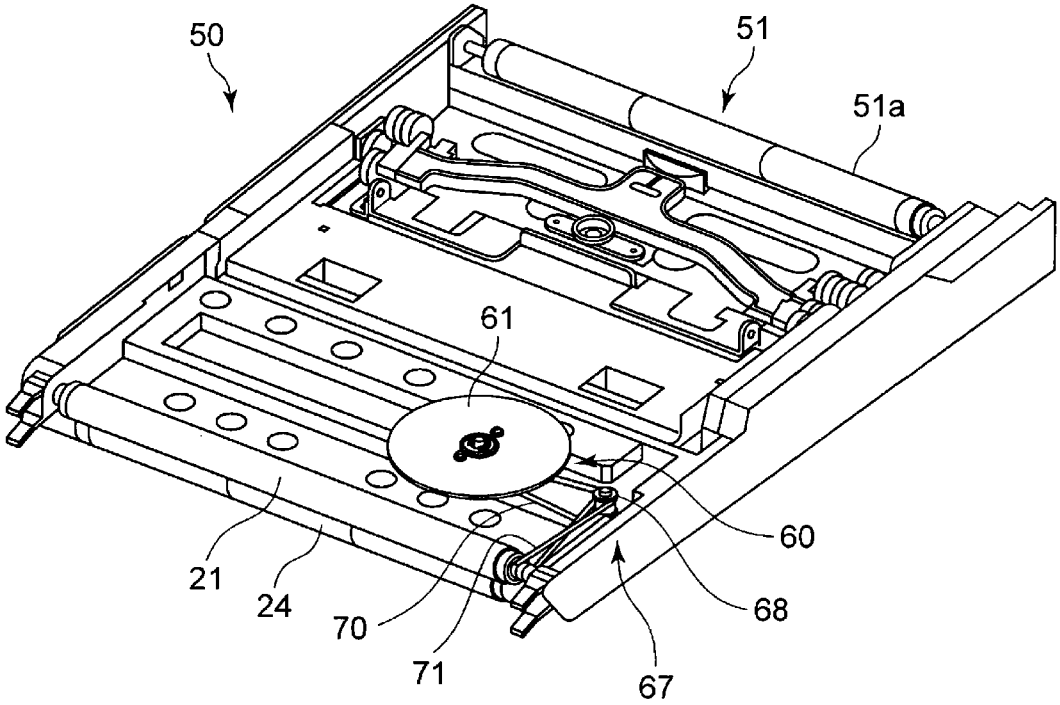
FIG. 4 is a schematic perspective view showing the transfer belt unit which a transfer belt is removed of the embodiment.
Figure 5:
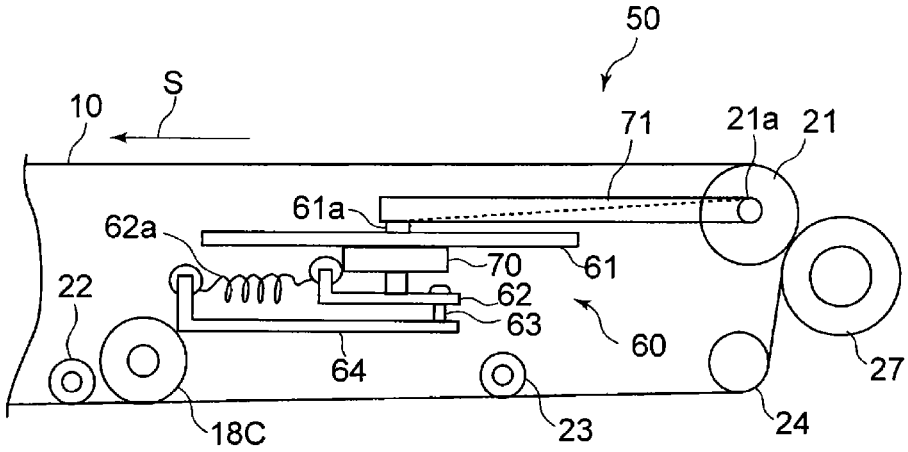
FIG. 5 is a schematic structural view showing attachment of a flywheel mechanism of the embodiment.

Next, the flywheel mechanism 60 will be described in detail. As shown in FIG. 4, the transfer belt unit 50 contains the flywheel mechanism 60 in the hollow inside of the intermediate transfer belt 10. As shown in FIG. 5, the flywheel mechanism 60 includes a disk-like flywheel 61 as a flywheel and a link mechanism 67 as a coupling. A board 62 fixes and supports a shaft 61*a* of the flywheel 61. After the flywheel 61 is positioned with respect to the driven roller 21, the board 62 is fixed by a screw 63 to a support plate 64. A spring 62*a* is used at the time of positioning of the flywheel 61. The flywheel 61 is almost parallel to the plane portion of the intermediate transfer belt 10 in the hollow inside of the intermediate transfer belt 10. A direction of the shaft 61*a* of the flywheel 61 has an angle of 90° with respect to a direction of a shaft 21*a* of the driven roller 21.

Figure 6:
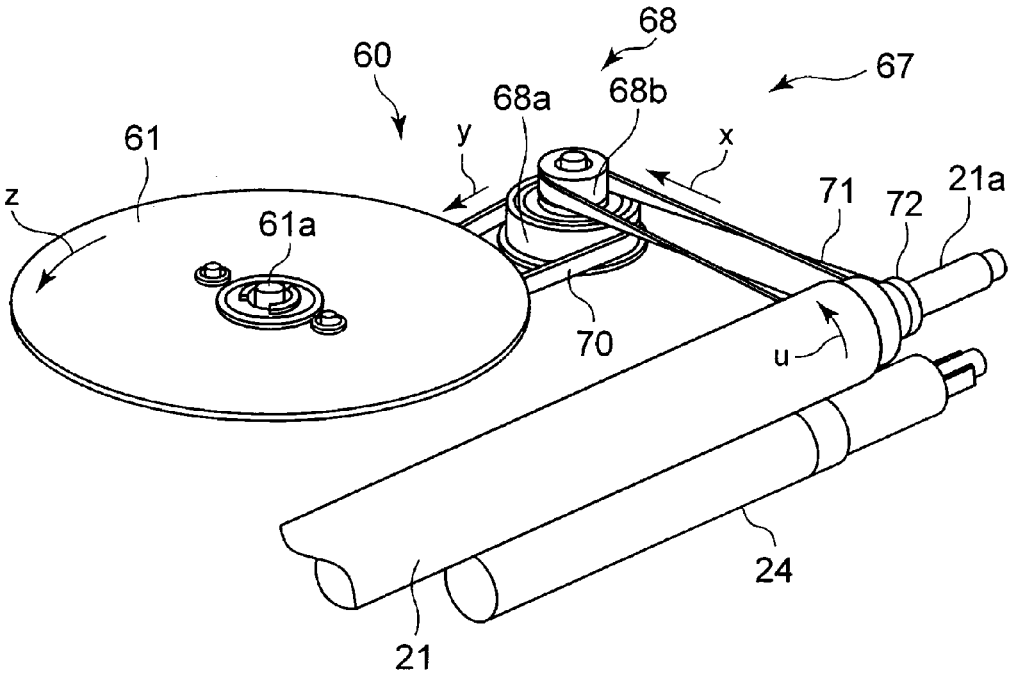
FIG. 6 is a schematic perspective view showing a flywheel mechanism of the embodiment.
Figure 7:
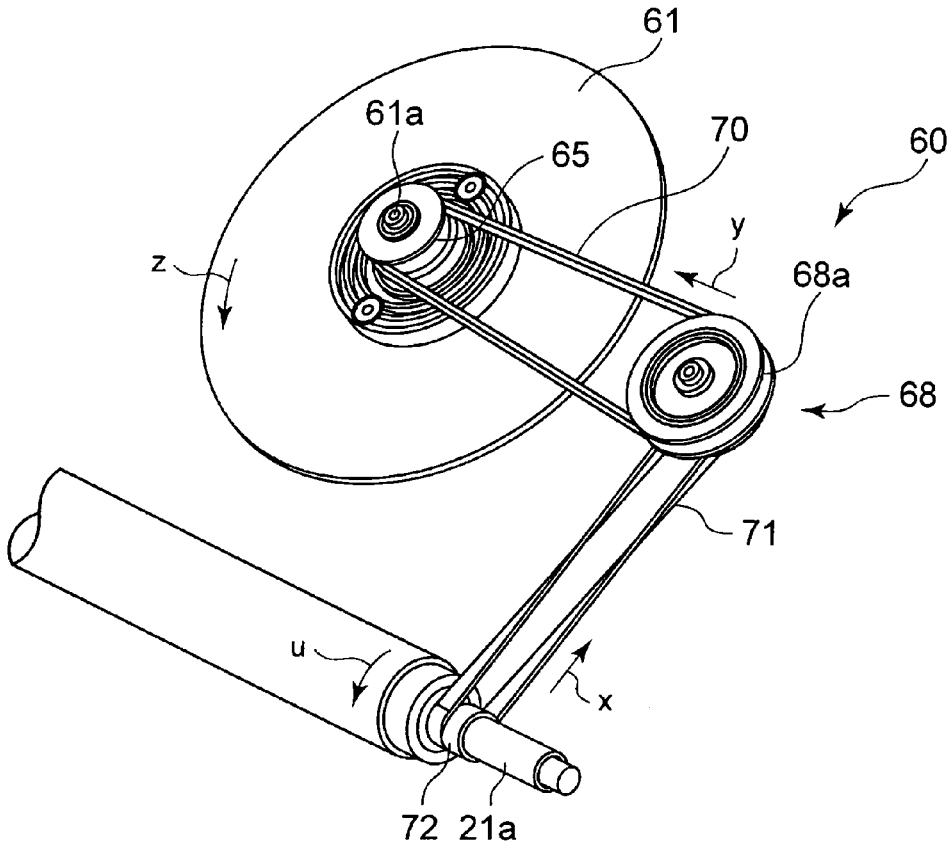
FIG. 7 is a schematic perspective view showing the flywheel mechanism of the embodiment seen from below.

As shown in FIG. 6 and FIG. 7, the link mechanism 67 couples the flywheel 61 to the driven roller 21. The link mechanism 67 includes a gear section 68, and, as a coupling belt, a first belt 70 and a second belt 71. The gear section 68 includes a second gear 68*a* having a diameter larger than a first gear 65 of the flywheel 61 and a third gear 68*b* having a diameter smaller than the second gear 68*a*. The second gear 68*a* and the third gear 68*b* are integrally rotated. The diameter of the third gear 68*b* is smaller than the diameter of a fourth gear 72 of the driven roller 21. The first belt 70 is formed of a timing belt engaged with the first gear 65 and the second gear 68*a*, and is stretched between the first gear 65 and the second gear 68*a*. The second belt 71 is formed of a timing belt engaged with the third gear 68*b* and the fourth gear 72, and is stretched between the third gear 68*b* and the fourth gear 72 of the driven roller 21. The link mechanism 67 increases the rotation speed of the fourth gear 72 as the rotation speed of the driven roller 21, and transmits it to the first gear 65 of the flywheel 61.

Figure 8:
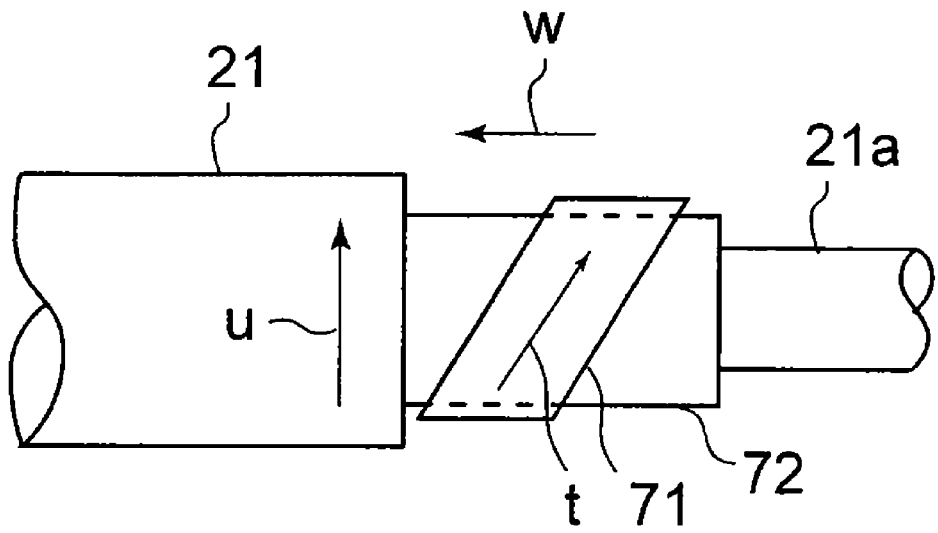
FIG. 8 is a schematic explanatory view showing a twisting direction of a second belt of the embodiment.

Since the direction of the shaft 61*a* of the flywheel 61 has an angle of 90° with respect to the direction of the shaft 21*a* of the driven roller 21, in order to couple the flywheel 61 to the driven roller 21, the second belt 71 is twisted and is stretched between the third gear 68*b* and the fourth gear 72. The twisting direction of the second belt 71 is shown in FIG. 8. The twisting direction of the second belt 71 is the direction inclined in the direction of separating from the driven roller 21 on the fourth gear 72 as indicated by an arrow t.

The traveling direction of the second belt 71 originally tends to be corrected so that the second belt travels along an arrow u direction as the rotation direction of the shaft 21*a* of the driven roller 21. Accordingly, by twisting the second belt 71 in the direction shown in FIG. 8, the second belt 71 tends to move in a direction way to the driven roller 21 as an arrow w direction. From this, there is no fear that the second belt 71 falls off from the fourth gear 72 and from the shaft 21*a*. Accordingly, it becomes unnecessary to provide a flange on the shaft 21*a* of the driven roller 21.

Figure 9:
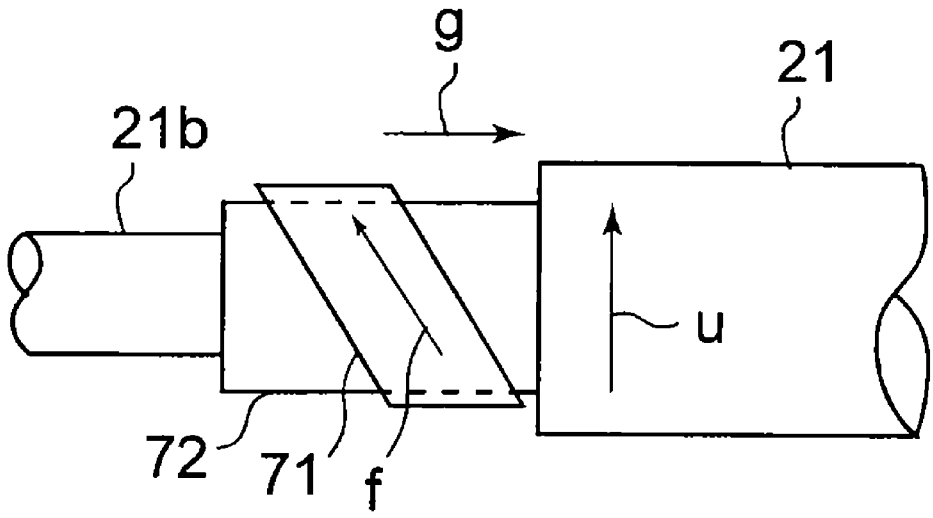
FIG. 9 is a schematic explanatory view showing another example of the twisting direction of the second belt of the embodiment.

Incidentally, for example, as shown in FIG. 9, when the second belt 71 is hung on the other shaft 21*b* of the driven roller 21, the second belt 71 is twisted in a direction opposite to that of FIG. 8. As shown by an arrow f of FIG. 9, when the second belt 71 is inclined in the direction away from the driven roller 21, the second belt 71 tends to move in a direction way to the driven roller 21 as an arrow g direction so that it travels along the arrow u direction as the rotation direction of the shaft 21*b* of the driven roller 21.

When the intermediate transfer belt 10 travels in the arrow s direction, and the driven roller 21 rotates in the arrow u direction, the second belt 71 rotates in an arrow x direction. Further, the first belt 70 rotates in an arrow y direction through the gear section 68, and the flywheel 61 rotates in an arrow z direction. The flywheel 61 is rotated, so that the shaft 21*a* of the driven roller 21 has a large inertia moment. The flywheel 61 is rotated, so that the rotation of the driven roller 21 is stabilized.

Next, the operation of the flywheel mechanism 60 will be described. When a print operation is started in the printer section 6, the sheet P travels from the sheet feed cassette 4 or the manual feed mechanism 31 to the position of the resister roller pair 36. The sheet P whose leading edge comes in contact with the registration roller pair 36 and is aligned reaches the secondary transfer position by the rotation of the registration roller pair 36. At the secondary transfer position, a force is applied to the intermediate transfer belt 10 by an impact force generated when the sheet P enters between the intermediate transfer belt 10 and the secondary transfer roller 27. The speed fluctuation of the intermediate transfer belt is caused by the force applied to the intermediate transfer belt 10.

However, the driven roller 21 to support the intermediate transfer belt 10 is coupled to the flywheel 61. The flywheel 61 rotates at the time of rotation of the driven roller 21, so that the driven roller 21 has a large inertia moment. The rotation of the driven roller 21 is stabilized by the inertia moment. Accordingly, although the force to cause the speed fluctuation is applied to the intermediate transfer belt 10 by the impact force generated when the sheet P enters the secondary transfer position, the speed fluctuation of the intermediate transfer belt 10 is suppressed by the support of the stably rotated driven roller 21. The intermediate transfer belt 10 stably rotates without speed fluctuation.

The sheet P having the toner image reaches the fixing device 30, and when the leading edge of the sheet P enters between the heat roller 30*a* and the pressure roller 30*b*, an impact force is applied to the sheet P. A speed fluctuation or vibration occurs at the leading edge of the sheet P by the impact force generated when the sheet enters the fixing device 30. The speed fluctuation or vibration of the leading edge of the sheet P is transmitted to the secondary transfer position. By the transmitted speed fluctuation or vibration of the sheet P, a force to cause speed fluctuation is applied to the intermediate transfer belt 10.

However, the rotation of the driven roller 21 is stabilized by the large inertia moment due to the rotation of the flywheel 61. Accordingly, although the force to cause the speed fluctuation is applied to the intermediate transfer belt 10 by the impact force generated when the leading edge of the sheet P enters the fixing device 30, the speed fluctuation of the intermediate transfer belt 10 supported by the driven roller 21 is suppressed, and the intermediate transfer belt is stably rotated.

When the transfer of the toner image from the intermediate transfer belt 10 to the sheet P is proceed at the secondary transfer position, the trailing edge of the sheet P comes out from the registration roller pair 36. The trailing edge of the sheet P is subjected to speed fluctuation or is vibrated by an impact force generated when the trailing edge of the sheet P comes out from the registration roller pair 36. The speed fluctuation or vibration of the trailing edge of the sheet P is transmitted to the secondary transfer position. A force to cause speed fluctuation is applied to the intermediate transfer belt 10 by the transmitted speed fluctuation or vibration of the sheet P.

However, the rotation of the driven roller 21 is stabilized by the large inertia moment due to the rotation of the flywheel 61. Accordingly, although the force to cause the speed fluctuation is applied to the intermediate transfer belt 10 by the impact force generated when the trailing edge of the sheet P comes out from the resist roller pair 36, the speed fluctuation of the intermediate transfer belt 10 supported by the driven roller 21 is suppressed, and the intermediate transfer belt is stably rotated.

During the print operation, for example, when the leading edge of the sheet P enters between the intermediate transfer belt 10 and the secondary transfer roller 27, when the leading edge of the sheet P enters between the heat roller 30*a* and the pressure roller 30*b*, or when the trailing edge of the sheet P comes out from the registration roller pair 36, even if the impact is applied to the sheet P, the intermediate transfer belt 10 stably rotates. Accordingly, when the toner images on the respective photoconductive drums 12Y, 12M, 12C and 12K are primarily transferred to the intermediate transfer belt 10, or the toner images on the intermediate transfer belt 10 are secondarily transferred to the sheet P, a transfer blur can be prevented and a superior transfer image can be obtained.

When the maintenance of the transfer belt unit 50 is performed, the transfer belt unit 50 is pulled out from the front or the side of the color copier 1. At this time, the flywheel mechanism 60 contained in the hollow inside of the intermediate transfer belt 10 is also pulled out without changing its state. It is not necessary to perform such an operation as to remove the flywheel mechanism 60 before the transfer belt unit 50 is pulled out from the color copier 1. After the end of the maintenance, in the state where the flywheel mechanism 60 is mounted, the transfer belt unit 50 is mounted in the color copier 1.

According to this embodiment, the flywheel mechanism 60 is coupled to the driven roller 21 to support the intermediate transfer belt 10 at the secondary transfer position. By this, the driven roller 21 has the large inertia moment at the time of rotation. The rotation of the driven roller 21 is stabilized. Even if the sheet P being nipped and conveyed by the intermediate transfer belt 10 and the secondary transfer roller 27 receives the impact force, and the force to cause the speed fluctuation is applied to the intermediate transfer belt 10, the intermediate transfer belt 10 supported by the stably rotated driven roller 21 is stably rotated. In both the primary transfer and the secondary transfer, the transfer blur due to the speed fluctuation of the intermediate transfer belt 10 is prevented, and the superior transfer image can be obtained.

According to the embodiment, the flywheel mechanism 60 is arranged in the hollow inside of the intermediate transfer belt 10. By this, when the transfer belt unit 50 is attached to or detached from the color copier 1 at the time of maintenance or the like, the flywheel mechanism 60 can be pulled out together. When the transfer belt unit 50 is attached to or detached from the color copier 1, there is no fear that the flywheel mechanism 60 prevents the attachment or detachment operation.

According to the embodiment, the first belt 70 and the second belt 71 are made of the timing belts. By this, the rotation can be certainly transmitted between the driven roller 21 and the flywheel 61, and the driven roller 21 can efficiently obtain the large inertia moment. Besides, the second belt 71 is twisted in the direction of moving to the driven roller 21 side from the fourth gear 72. By this, there is no fear that the second belt 71 falls off from the shaft 21*a* of the driven roller 21, and a flange for preventing falling-off becomes unnecessary. Further, the link mechanism 67 is set so that the rotation speed of the flywheel 61 becomes high as compared with the rotation speed of the driven roller 21. By this, even if the diameter of the flywheel 61 is the same, the inertia moment generated in the driven roller 21 can be made larger.

The invention is not limited to the above embodiment, but can be variously modified within the scope of the invention. For example, as long as the flywheel is provided inside the transfer belt the arrangement position, the arrangement angle, the size of the flywheel, the material and the like are not limited. The structure of the coupling is also arbitrary, and contrary to the embodiment in which the rotation speed of the flywheel is increased as compared with the rotation speed of the support roller, the rotation speed of the support roller may be set to be equal to the rotation speed of the flywheel. Besides, as long as the rotation can be certainly transmitted between the support roller and the flywheel in the link mechanism 67, the coupling belt is not limited to the timing belt, but may be a metal belt having rigidity or the like. The twisting direction of the coupling belt, which is twisted to compensate the angle formed between the shaft of the flywheel and the shaft of the support roller, is also not limited. However, when the coupling belt is twisted reversely to that shown in the embodiment, as the coupling belt travels, it moves in the direction of separating from the support roller, and therefore, it is necessary to provide a flange in order to prevent the coupling belt from falling off.

What is claimed is:

1. A transfer belt unit comprising:

an endless transfer belt that nips a recording medium between the endless transfer belt and an opposite member and conveys the recording medium;

a support roller to support the transfer belt at a position where the recording medium is nipped;

a flywheel arranged in a hollow inside of the transfer belt and a coupling to couple the flywheel to the support roller.

2. The unit of claim 1, wherein a direction of a shaft of the flywheel and a direction of a shaft of the support roller form an angle.

3. The unit of claim 2, wherein the angle is 90°.

4. The unit of claim 3, wherein the opposite member is a secondary transfer roller and the coupling includes a coupling belt twisted by 90°.

5. The unit of claim 4, wherein the coupling belt is a timing belt.

6. The unit of claim 4, wherein a twisting direction of the coupling belt is a direction along which the coupling belt on the shaft of the support roller separates from the support roller when the coupling belt is traveling.

7. The unit of claim 1, wherein the flywheel is arranged to be parallel to a plain section of the transfer belt.

8. The unit of claim 1, wherein the coupling is set to cause a rotation speed of the flywheel to become higher than a rotation speed of the support roller.

9. An image forming apparatus comprising:

an endless transfer belt;

an image forming member to form an image on the transfer belt;

an opposite member that, together with the transfer belt, nips and conveys a recording medium at a transfer position;

a support roller to support the transfer belt at the transfer position;

a flywheel arranged in a hollow inside of the transfer belt; and a coupling to couple the flywheel to the support roller.

10. The apparatus of claim 9, wherein a direction of a shaft of the flywheel and a direction of a shaft of the support roller form an angle.

11. The apparatus of claim 10, wherein the angle is 90°.

12. The apparatus of claim 11, wherein the opposite member is a secondary transfer roller and the coupling includes a coupling belt twisted by 90°.

13. The apparatus unit of claim 12, wherein the coupling belt is a timing belt.

14. The apparatus of claim 12, wherein a twisting direction of the coupling belt is a direction along which the coupling belt on the shaft of the support roller separates from the support roller when the coupling belt is traveling.

15. The apparatus of claim 9, wherein the flywheel is arranged to be parallel to a plain section of the transfer belt.

16. The apparatus of claim 9, wherein the coupling is set to cause a rotation speed of the flywheel to become higher than a rotation speed of the support roller.

17. A method of preventing a transfer blur in an image forming apparatus, comprising:

arranging a flywheel in a hollow inside of a transfer belt having an image;

coupling a support roller to support the transfer belt to the flywheel at a transfer position; and transferring the image from the transfer belt to a recording medium, by nipping and conveying a recording medium by the transfer belt and an opposite member at the transfer position.

18. The method of claim 17, wherein the flywheel is arranged to be parallel to a plane section of the transfer belt.

19. The method of claim 18, wherein the support roller is coupled to the flywheel by using a twisted coupling belt.

20. The method of claim 19, wherein a twisting direction of the coupling belt is a direction in which the coupling belt moves toward the support roller on a shaft of the support roller.

21. The method of claim 17, wherein the support roller is coupled to the flywheel to cause a rotation speed of the flywheel to become higher than a rotation speed of the support roller.

* * * * *